US005096002A

United States Patent [19]

Cherrington

[11] Patent Number: 5,096,002

[45] Date of Patent: Mar. 17, 1992

[54] METHOD AND APPARATUS FOR ENLARGING AN UNDERGROUND PATH

[75] Inventor: Martin D. Cherrington, Fair Oaks, Calif.

[73] Assignee: Cherrington Corporation, Sacramento, California

[21] Appl. No.: 557,992

[22] Filed: Jul. 26, 1990

[51] Int. Cl.[5] ..... E21D 1/06

[52] U.S. Cl. ..... 175/53; 175/61; 175/84

[58] Field of Search ..... 175/19-23, 175/53, 61, 84

[56] References Cited

U.S. PATENT DOCUMENTS 3,536,151 10/1970 Aarup ..... 175/21 X
4,091,631 5/1978 Cherrington ..... 175/62 X
4,117,895 10/1978 Ward et al. ..... 175/53
4,121,673 10/1978 Cherrington .
4,176,985 12/1979 Cherrington .
4,221,503 9/1980 Cherrington .
4,453,603 6/1984 Voss et al. ..... 175/53
4,674,579 6/1987 Geller et al. ..... 175/61 X
4,679,637 7/1987 Cherrington et al. .
4,714,118 12/1987 Baker et al. ..... 175/67 X
4,784,230 11/1988 Cherrington et al. .
4,858,705 8/1989 Thiery ..... 175/61 X

*Primary Examiner*—Ramon S. Britts
*Assistant Examiner*—Roger J. Schoeppel
*Attorney, Agent, or Firm*—Vinson & Elkins

[57] ABSTRACT

A method and apparatus for enlarging an inverted arcuate underground path between two surface locations is disclosed, where the cuttings from the enlarging are removed. After the drilling of a pilot borehole, and possibly after some reaming operations, a reamer and hole cleaner are pulled through the path, with the reamer rotating as the drill string in the path rotates. The rotation of the drill string also powers a positive displacement pump inside of the hole cleaner, which pumps fluid and entrained cuttings to the surface behind the hole cleaner. Fluid may also be pumped into the reamer from behind the hole cleaner, preferably by way of an inlet pipe which surrounds the outlet from the pump. The hole cleaner includes an agitator, also powered by the rotation of the drill string, which agitates the fluid and cuttings while the drill string is rotated but is not being pulled to the surface. Pressure control may be maintained either by monitoring the fluid in and out of the path together with the volume of the cuttings, or by direct monitoring of the pressure at the reamer.

30 Claims, 4 Drawing Sheets

METHOD AND APPARATUS FOR ENLARGING AN UNDERGROUND PATH

This invention is in the field of installing underground conduits, and is more specifically directed to the enlarging of the path into which such conduits are installed.

BACKGROUND OF THE INVENTION

Underground conduits are widely used for the transmission of fluids, such as in pipelines and the like, as well as for carrying wires and cables for the transmission of electrical power and electrical communication signals. While the installation of such conduits is time-consuming and costly for locations where the earth can be excavated from the surface, the routing of such conduits becomes more difficult where such surface excavation cannot be done due to the presence of surface obstacles through which the excavation cannot easily proceed. Such surface obstacles include highways and railroads, where the installation of a crossing conduit would require the shutdown of traffic during the excavation and installation. Such surface obstacles also include rivers, which present extremely difficult problems for installing a crossing conduit, due to their size and the difficulty of excavation thereunder.

Prior methods for the installation of conduit have included the use of directional drilling for the formation of an inverted underground arcuate path extending between two surface locations and under the surface obstacle, with the conduit installed along the drilled path. A conventional and useful method for installing such underground conduits is disclosed in U.S. Pat. No. 4,679,637, issued July 14, 1987, assigned to Cherrington Corporation, and incorporated herein by this reference. This patent discloses a method for forming an enlarged arcuate bore and installing a conduit therein, beginning with the directional drilling of a pilot hole between the surface locations and under a surface obstacle such as a river. Following the drilling of the pilot hole, a reamer is pulled with the pilot drill string from the exit opening toward the entry opening, in order to enlarge the pilot hole to a size which will accept the conduit, or production casing in the case of a pipeline conduit. The conduit may be installed during the reaming operation, by the connection of a swivel behind the reamer and the connection of the conduit to the swivel, so that the conduit is installed as the reaming of the hole is performed. Alternatively, the conduit can be installed in a separate operation, following the reaming of the pilot hole (such reaming referred to as "pre-reaming" of the hole). Additional examples of the reaming operation, both as pre-reaming and in conjunction with the simultaneous installation of the product conduit, are described in U.S. Pat. No. 4,784,230, issued Nov. 15, 1988, assigned to Cherrington Corporation and incorporated by this reference.

While the above-described methods are generally successful in the installation of such conduit, certain problems have been observed, especially as the length of the conduit exceeds one mile in length, and especially where certain types of sub-surface formations are encountered. Referring now to FIGS. 1 and 2, examples of such problems in the installation of conduit in an underground arcuate path will now be described.

FIG. 1 illustrates the reaming operation described above, in conjunction with the installation of production conduit as the reamer is pulled back. In the example of FIG. 1, entry opening O is at surface S on one side of river R; exit opening E is on the other side of river R from entry opening O. At the point in the installation process illustrated in FIG. 1, a drilling apparatus, including a hydraulic motor 114 mounted on a carriage 116 which is in place on an inclined ramp 112, has drilled the pilot borehole B from entry O to exit E, using drill string 110, and the reaming and installation is in progress. Motor 114 is now pulling reamer 48, to which production conduit 46 is mounted, back from exit E toward entry O. Reamer 48 is larger in diameter than the diameter of production conduit 46. Upon completion of the reaming operation of FIG. 1, if successful, production conduit 46 will be in place under river R, and extending between exit E and entry O.

Referring now to FIG. 2, a close-up view of the location of reamer 48 and production conduit 46 in FIG. 1 is now illustrated. Leading drill string section 110C is attached by way of tool joint 52 to reamer 48, reamer 48 having cutting teeth at its face. Swivel 50 connects product conduit 46 to reamer 48, by way of extension 62 connected to a sleeve 66 on conduit 46. As is evident from FIGS. 1 and 2, borehole B is enlarged to enlarged opening D by operation of reamer 48. Conventional sizes of conduit 46 are on the order of 20 to 48 inches in outside diameter, with the size of reamer 48 greater in diameter than conduit 46. Due to reamer 48 being larger than conduit 46, an annulus 68 surrounds conduit 46 as it is pulled into the hole D. Provision of the annulus 68 allows for reduced friction as the conduit 46 is placed therein.

As noted above, prior techniques have also included a pre-reaming step, wherein a reamer such as reamer 48 is pulled back from exit E to entry 0 without also pulling production conduit 46 into the reamed hole. In such a pre-reaming step, a following pipe generally trails reamer 48 in such the same manner as conduit 46 trails reamer 48 in FIGS. 1 and 2, to provide a string for later installation of conduit 46. Such a trailing pipe will be of a much smaller size than conduit 46 of FIGS. 1 and 2, for example on the order of five to ten inches in diameter.

It has been observed in the field that both the pre-reaming and reaming with installation operations are subject to conduit or pipe sticking problems, especially as the size of the production conduit increases in diameter, and as the length of the path from entry O to exit E increases. Such sticking is believed to be due, in large degree, to the inability to remove cuttings resulting from the reaming operation. Due to the large volume of earth which is cut by way of the reaming operation, and the generally low fluid flow velocity of drilling or lubricating mud or fluid into the reaming location, the velocity of cuttings circulating from the reaming location is minimal. While the mud or other lubricating fluid flow could be increased in order to increase the velocity of the cuttings from the reaming location, such an increase in the velocity of the fluid could result in such undesired results as hole wall erosion and fracturing through the formation.

Due to the inability to sufficiently remove the cuttings during the reaming operation, it is believed that the cuttings pack together near the location of the reamer. Many of the cuttings from the reaming operation are heavier than the fluid transporting them and, in such large diameter holes as are required for the installation of conduit, these large cuttings will fall out or settle toward the bottom of the hole first, and then build up into a circumferential packed mass, especially when the rate of reaming is poor, as will be described hereinbelow. Referring to FIG. 2, where a production conduit 46 is being pulled through with reamer 48, it is believed that such packing will begin at locations P surrounding the leading end of conduit 46, and also along the sides of conduit 46 in annulus 68. As the cuttings pack together, squeezing out whatever water or fluid is present therein, the density of the packed mass increases. Upon sufficient packing, it is believed that pressure builds up ahead of locations P, toward the bit of reamer 48, such pressure resulting from the mud or fluid continuing to be pumped into the reaming location with the return flow reduced at locations P around conduit 46 in annulus 68. It is also believed that this buildup of pressure will also force cuttings into borehole B ahead of reamer 48, and that these cuttings will also begin to pack, most likely at locations P' near the first tool joint 70 ahead of reamer 48.

The buildup of pressure between locations P and P' surrounding reamer 48 causes significant problems in the reaming operation. Such effects have been observed in the field during reaming operations, when the reamer cannot be rotated, pulled or pushed at a particular location in the operation. It should be noted that the sticking of the reamer occurs both for the pre-reaming operation described hereinabove and for the combined reaming and pulling operation. It should further be noted that the pressure buildup described hereinabove is believed to be worse in high pressure formations such as clay.

Another undesired effect resulting from the buildup of pressure when the reamer cuttings are insufficiently removed is similar in nature to differential sticking in the downhole drilling field. As is well known in the downhole drilling art, differential sticking of the drill string occurs when the pressure of the drilling mud surrounding the drill string is greater than the pressure exerted by the surrounding formation. In the event that the caking of drilling mud and the structure of the well bore is not strong enough to maintain its shape when presented with such a differential pressure, the pressure of the drilling mud can force the drill string into the formation, holding it there with sufficient pressure that it cannot be released from the surface.

It is now believed that similar effects can be present in the field of installation of underground conduit, due to insufficient removal of the reaming cuttings. If the pressure near reamer 48, when packed off as described hereinabove, is sufficiently greater than the pressure exerted by a surrounding formation, the conduit 46 can be driven into the formation, causing sticking of the conduit 46 thereat. It should be noted that the installation of underground conduit is particularly susceptible to such sticking, since much of the formations underlying rivers are sedimentary or alluvial formations, with relatively thin layers of differing strength. Accordingly, the drilling and reaming operations in river crossing installations are exposed to many differing formations along the length of the path, with the likelihood of encountering a weak (in pressure) formation being relatively large. Accordingly, such pressure buildup due to insufficient reaming cutting removal can cause conduit sticking at particular locations along the underground path.

Furthermore, it should be noted that the insufficient removal of cuttings impacts the reaming operation itself. If cuttings are not sufficiently removed from the reaming location, a number of cuttings will tend to be present in front of reamer 48 of FIG. 2; as a result, reamer 48 will tend to recut its own cuttings, rather than cutting the earth in its path and enlarging the hole. This results in poor penetration rates for the reaming operation. As noted above, as the reaming rate slows, the pressure buildup between the packed locations will accelerate, further degrading the operation and increasing the likelihood of the reamer and conduit sticking. In addition, the recutting of the cuttings results in a high degree of reamer wear, both at the teeth and also in the parent metal of reamer 48. In rotor reamers, such wear has been observed also at the seals and bearings. This has also been observed for reamers which use carbide-coated rotating cones as the cutting bits, in similar manner as a downhole tri-cone bit; while the carbide wears slowly, the insufficient removal of the cuttings has been evidence in significant wear of the parent metal of the reamer.

Other methods for installing conduit in an underground path includes forward thrust techniques, such as described in U.S. Pat. Nos. 4,176,985, 4,221,503 and 4,121,673. Particularly, U.S. Pat. No. 4,176,985 discloses an apparatus which thrusts a casing into a pilot hole, with a bit leading the casing. However, while such forward thrust techniques are useful for unidirectional application such as the introduction of conduits into the ocean, such methods place significant stress on the conduit itself, and also present relatively slow installation rates. The pull-back methods described hereinabove and hereinbelow are preferable from the standpoint of reduced stress on the casing, as well as increased installation rates.

It is therefore an object to provide a method and apparatus of removing cuttings from the reaming operation in a method of installing underground conduit.

It is a further object of this invention to provide such a method and apparatus which is useful in a pre-reaming operation.

It is a further object of this invention to provide such a method and apparatus which is useful in an operation where the conduit is installed during the reaming operation.

It is a further object of this invention to provide such a method and apparatus which provides control of the pressure at the reaming location.

It is a further object of this invention to provide such a method and apparatus which includes agitation of the cuttings so that packing of the cuttings does not occur during a standstill in the reaming operation.

It is a further object of this invention to provide such a method and apparatus which provides a fluid return from the reamer which may easily be cleaned out in the event the return backs up.

It is a further object of this invention to provide such a method and apparatus which includes the solids control and pumping on the same side of the surface obstacle.

Other objects and advantages of the invention will be apparent to those of ordinary skill in the art having reference to the following specification, together with its drawings.

SUMMARY OF THE INVENTION

The invention may be incorporated into an apparatus and method for installing underground conduit, by the inclusion of an apparatus for removing the cuttings from behind a reamer being pulled along a pilot borehole. The removing apparatus includes an intake grate for allowing the smaller cuttings to pass behind the reamer, followed by a paddle and pump to agitate the cuttings and pump the cuttings out to a location behind the reamer. Production conduit may follow the cutting removal apparatus, if the installation is to be done simultaneously with the reaming; alternatively, the removing apparatus may be used in a pre-reaming operation. The cuttings may be returned to the surface in a pipe, rather than an annulus, which allows for ease in cleaning out if the flow is plugged.

DETAILED DESCRIPTION OF THE PREFERRED EMBODIMENT

Figure 2:
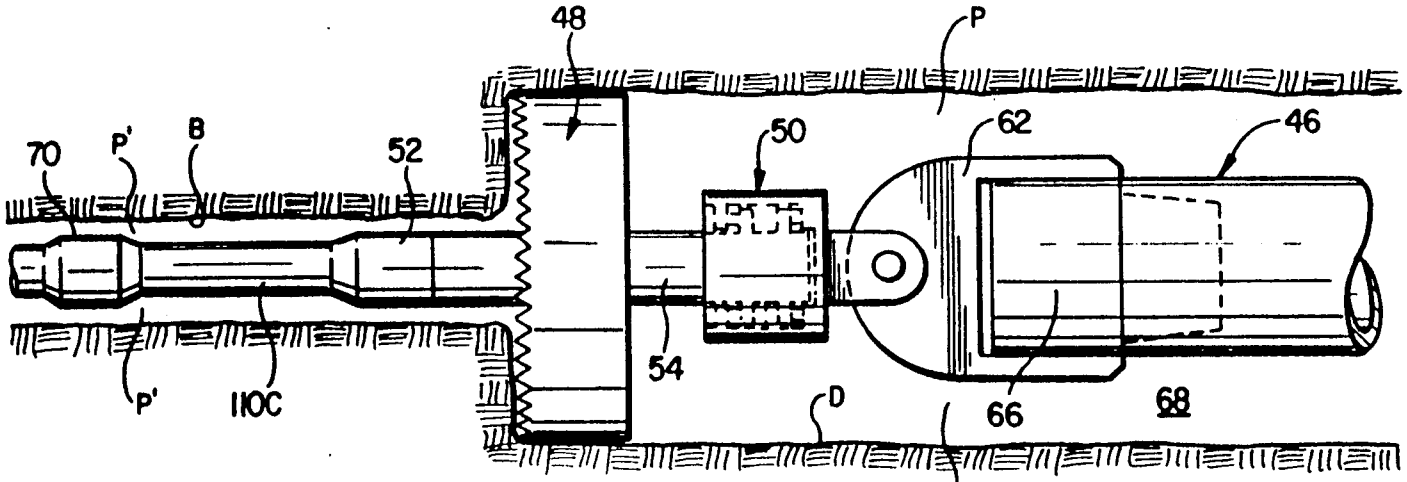
FIG. 2 (PRIOR ART)
Figure 3:
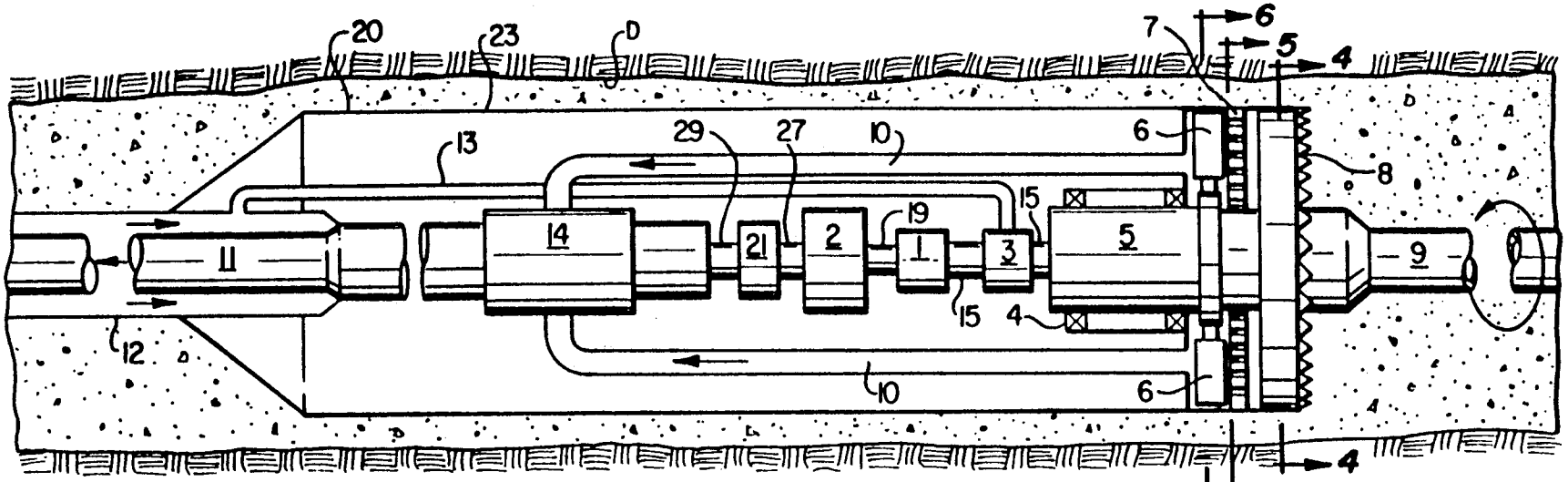
FIG. 3 is a cross-sectional diagram of a reamer and cutting removal apparatus according to the preferred embodiment of the invention.

Referring now to FIG. 3, a cross-sectional diagram of hole cleaner 20 according to the preferred embodiment of the invention will now be described. It should be noted that hole cleaner 20 of FIG. 3 is oriented in a direction opposite to that of FIGS. 1 and 2; i.e., hole cleaner 20 travels from left to right in FIG. 3 during a reaming operation. It should also be noted that hole cleaner 20 will be described herein as incorporated into a pre-reaming operation, with no production conduit following hole cleaner 20. It is contemplated, however, as will be described hereinbelow, that a swivel and production casing can be installed to follow hole cleaner 20 in the same manner as described hereinabove relative to the prior art reaming and installing operation.

Figure 4:
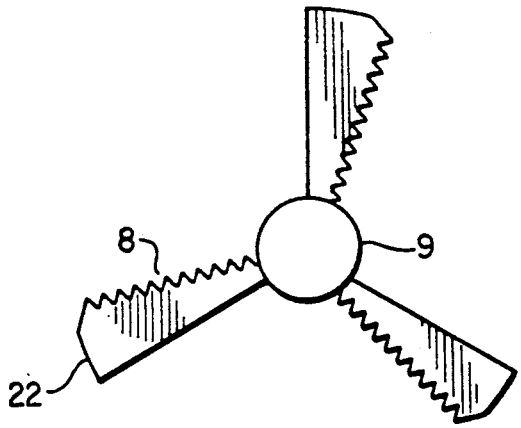
FIG. 4 is a frontal view of the reamer according to the embodiment of FIG. 3.

Hole cleaner 20 includes a housing 23, within which the operative components of hole cleaner are disposed. The leading end of hole cleaner 20 is a conventional flying reamer 8. FIG. 4 illustrates a frontal view of reamer 8, having in this case three blades 22 with numerous teeth thereupon, as is conventional for such reamers; in this example, reamer 8 is on the order of 26 inches in diameter. It should be noted that alternative types of reamers may be used in hole cleaner 20 according to the invention, including those with multiple carbide-tipped roller cone bits, similar to tri-cone roller bits used in the downhole drilling industry. Reamer 8 is connected to drill pipe 9, which is rotated and pulled from the surface, for example from entry location O of FIG. 1. The rotation and pulling of drill pipe 9 powers the cutting operation cf reamer 8, in the conventional manner.

Figure 5:
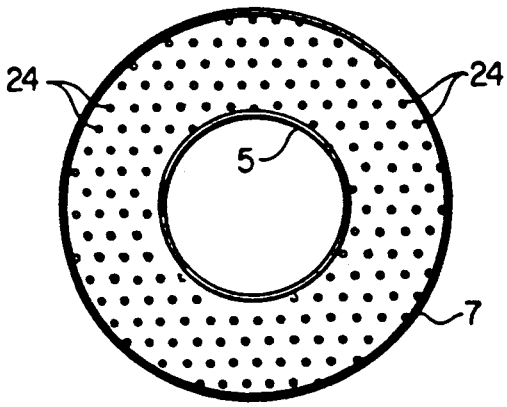
FIG. 5 is a frontal view of the intake grate of the embodiment of FIG. 3.

Located behind reamer 8 in hole cleaner 20 is intake grill 7. A frontal view of intake grill 7 is shown in FIG. 5. Intake grill 7 includes a plurality of holes 24 therethrough, which are sized in such a manner as to allow cuttings of a certain size and smaller to pass therethrough; for example, the diameter of holes 24 is on the order of one inch. Only the cuttings larger than the holes 24 in intake grill 7 will be recut by reamer 8, until the cuttings are sufficiently small as to pass through holes 24. In this way, the cuttings are controlled so that the remaining path in hole cleaner 20 is not blocked by excessively large cuttings. As shown in FIG. 3, drill pipe 9 is connected through intake grill 7, and serves as the drive shaft for hole cleaner 20.

Figure 6:
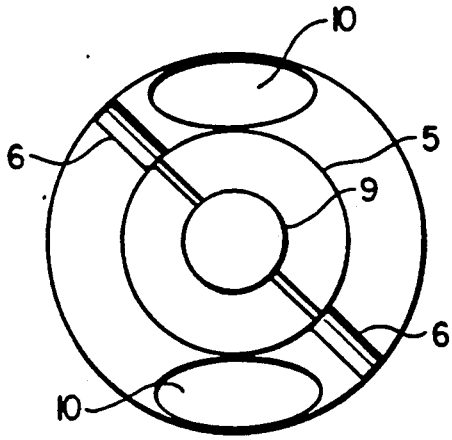
FIG. 6 is a frontal cross-sectional view of the paddle and pump intakes of the embodiment of FIG. 3.

Located behind intake grill 7, and connected to rotate with drill pipe 9, is paddle 6. Paddle 6 consists of two or more blades, which rotate around drill pipe 9 in hole cleaner 20 as drill pipe 9 is rotated from the surface. By operation of paddle 6, such cuttings as pass through intake grill 7 are agitated so long as drill pipe 9 is rotating. If the reaming operation is stopped, i.e., drill pipe 9 is rotated but not pulled from the surface, paddle 6 serves to prevent the settling of cuttings from the front of reamer 8 in the area immediately behind reamer 8, such settling possibly resulting in the plugging of intake pipes 10 located directly behind paddle 6. Intake pipes 10 are in fluid communication with the chamber in which paddle 6 is rotating. Intake pipes 10 connect this chamber behind intake grill 7 with positive displacement pump 14. FIG. 6 is a frontal view of hole cleaner 20 taken behind reamer 8, illustrating the relationship between paddle 6 and intake pipes 10.

Figure 8A:
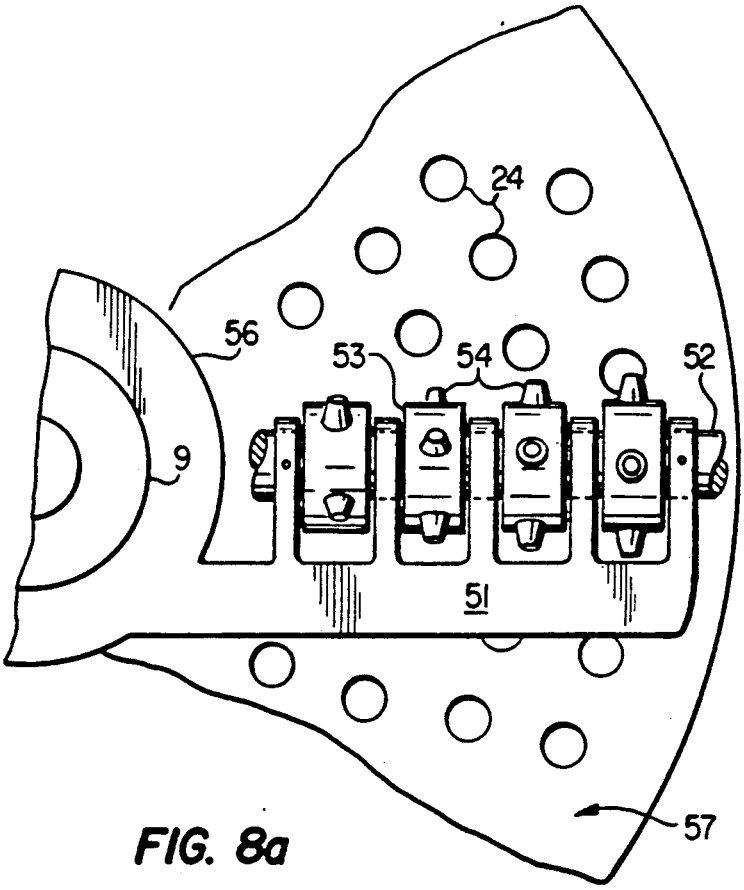
FIGS. 8*a* and 8*b* are views of an alternative embodiment of the paddle and pump intake of the embodiment of FIG. 3.
Figure 8B:
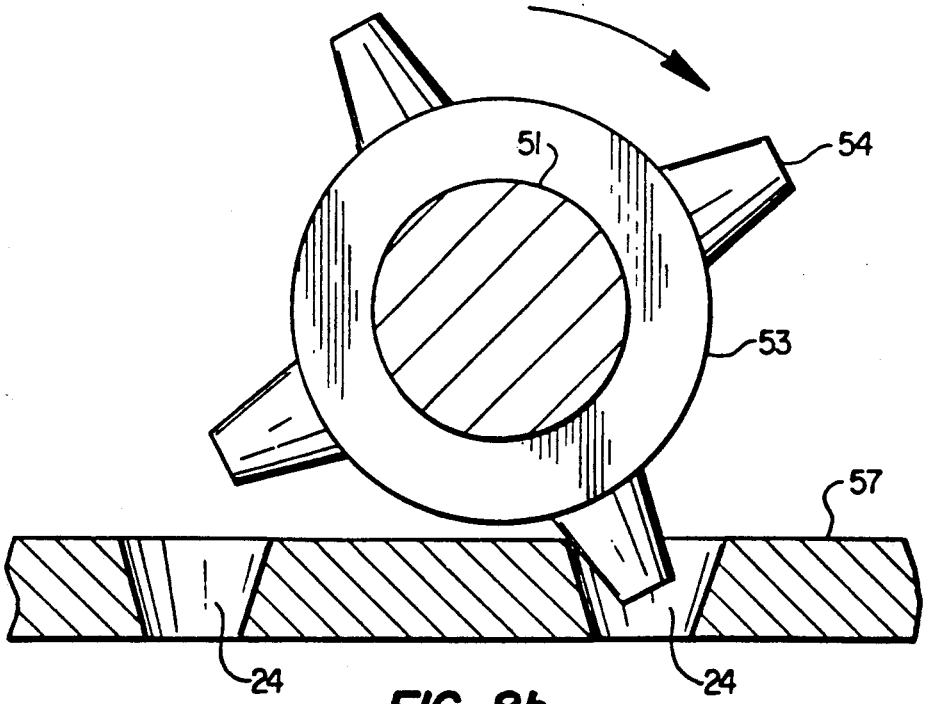

Referring to FIGS. 8*a* and 8*b*, an alternative embodiment of paddle 6 and intake grill 7 will now be described. It is contemplated that the use of hole cleaner 20 in certain types of formations, especially those containing a large fraction of clay, may have the potential for clogging holes 24 in intake grill 7. In other formations, holes 24 may also clog with rocks of similar size, or with other material encountered during the hole cleaning and enlarging operation described herein. The alternative embodiment of FIGS. 8*a* and 8*b* cleans holes 24, so that the possibility of packing of reamer 48 from clogging of the intake grill is reduced.

FIG. 8*a* is a partial rear view (i.e., taken in an opposite direction from that of FIG. 6) of intake grill 57 together with an arm 51 of a paddle 56 constructed according to this embodiment of the invention. Holes 24 in intake grill 57 are arranged radially about the axis of rotation of paddle 56, and in concentric rings about the axis. This arrangement of holes 24 allows arm 51 to clear clogs therein in the manner to be described hereinbelow.

Paddle arm 51 of paddle 56 is additional to those shown in FIG. 5, and is connected to the center of paddle 56 so that it rotates with the rotation of drill string 9. Alternatively, arm 51 may have a paddle blade provided at the end thereof, thereby providing the agitation function described hereinabove. Connected to paddle arm 51 is: rod 52, which is extended therefrom. Mounted on rod 52 are sprockets 53, which are attached to rod 52 so as to freely rotate thereabout. Each of sprockets 53 have protruding teeth 54, in this example numbering four each. Teeth 54 are preferably shaped as truncated cones, and are of a size so as to fit within holes 24; for example, if holes 24 have a diameter on the order of one inch, the narrow end of each of teeth 54 may be on the order of one-half inch, with the end of teeth 54 at the point of attachment to sprocket 53 on the order of nearly one inch. Paddle arm 51 is mounted on paddle 56 closely to intake grill 57, so that teeth 54 on sprockets 53 will reach and protrude into holes 24 therein. FIG. 8*b* illustrates the relationship of the teeth 54 on sprockets 53 with holes 24 in intake grill 57, in a cross-sectional view of a sprocket 53 on rod 52. For best results, the size of sprockets 53 and the number of teeth 54 on each sprocket will depend upon the spacing of holes 24 in intake grill 57, for the ring associated with the particular sprocket.

In operation, as paddle 56 rotates along with drill string 9, arm 51 will also rotate about the axis of drill string 9. Teeth 54 will protrude into successive ones of holes 24 of intake grill 57 as arm 51 rotates thereabout; the free rotation of sprockets 53 on rod 52 will allow teeth 54 to mate up with each of the holes 24 in intake grill 57. If cuttings, earth, or rocks are stuck within a hole 24, teeth 54 will push the stuck material out of holes 24, and toward reamer 48, as it rotates past the hole 24. Reamer 48, as it rotates about the axis of drill string 9, is preferably placed sufficiently close to intake grill 57 so that reamer 48 shaves off the material which protrudes from intake grill 57 after being pushed outwardly by teeth 54. The shaving of the material by reamer 48, after being pushed out by teeth 54, will keep holes 24 of intake grill 57 clean, freeing any holes 24 which may be clogged by cuttings encountered in the earth.

Also included in hole cleaner 20 are bearings 4 and main shaft housing 5, within which drill pipe 9 is coupled. Bearings 4 preferably include both thrust and radial bearings to stabilize drill string 9 both radially and linearly. Drive shaft housing 5 is preferably a sealed housing, and is connected to housing 23. Within drive shaft housing 5, drive shaft 15 is threaded into drill pipe 9, or connected thereto via a connecting nut, so that drive shaft 15 exiting drive shaft housing 5 rotates along with drill pipe 9. Drive shaft 15 thus transfers the rotation of drill pipe 9 to positive displacement pump 14 in the manner noted below. Drive shaft 15 is a hollow shaft extending through side entry swivel 3 described hereinbelow, and connects to coupler 1, an example of which is a conventional HECO F spline hub together with a conventional hex coupling. Coupler 1 connects to gear box 2 via intermediate shaft 19; gear box 2 is a conventional planetary system, such as a Model 20, part number 50CF 466, planetary speed reducer manufactured and sold by HECO. Gear box 2 is provided to effect the proper revolution speed of pump 14 relative to the rotation of drill pipe 9, so that the operation of pump 14 can be optimized and controlled separately from the optimization and control of the reaming operation driven directly by drill pipe 9. In this embodiment of the invention, gear box 2 is connected in such a manner to speed up the rotation of its output shaft 27 relative to that of drill pipe 9; accordingly, output shaft 27 is of a larger diameter than drive shaft 15 and of intermediate shaft 19. Output shaft 27 from gear box 2 is connected to positive displacement pump 14, via a conventional second coupler 21; for example a Hub City 03-3200030 in combination with a Dodge PX110 BBS. Final shaft 29 from coupler 21 is connected directly to a conventional positive displacement pump 14, for example, a model SVG20 Moyno (Registered trademark of Robbins Myers) pump, which serves to pump the fluid and cuttings out from hole cleaner 20 via discharge pipe 11, as will be described hereinbelow.

It should be noted that, while FIG. 3 illustrates the direct drive of pump 14 via a series of shafts which are in-line with drill pipe 9, alternatively pump 14 may be driven by a drive shaft or other mechanism which is not necessarily in line with drill pipe 9. For example, output drive shaft 27 from gear box 2 could be offset from intermediate shaft 19, so that pump 14 is off of the center line of hole cleaner 20.

Drilling fluid or mud, for purposes of lubricating the reaming action of reamer 8, is provided from the surface (at exit E as will be shown hereinbelow), in the annulus between discharge pipe 11 and inlet pipe 12. Inlet pipe 12 is on the order of 9⅝ inches outside diameter, with discharge pipe on the order of 5½ inches outside diameter. Inlet line 13 is connected at the leading end of inlet pipe 12, within hole cleaner 20, and communicates the clean fluid from inlet pipe 12 to swivel 3. Swivel 3 is a conventional side entry swivel, for example a IF-DC Swivel manufactured and sold by King Oil Tools, Inc. Swivel 3 communicates the clean fluid from inlet pipe 12 via inlet line 13 forwardly to reamer 8; reamer 8, as is conventional, has jets at its leading face through which the clean lubricating or drilling fluid exits into the cutting area. Drive shaft 5, extending through swivel 3, is blocked off internally on the trailing side of swivel 3, to prevent fluid communication in the trailing direction.

Alternatively to the system for communication of clean fluid or mud via inlet pipe 12, inlet line 13 and swivel 3 described hereinabove, clean drilling fluid may be placed into the hole from exit opening E in such a manner that the hydrostatic pressure of the fluid in the hole reaches the reaming location at reamer 8, traveling around housing 23 of hole cleaner 20. The pumping out of fluid with entrained cuttings from discharge pipe 11 would provide a path for the flow of fluid from the surface to the reaming location and back again. In this alternative embodiment, inlet pipe 12, inlet line 13 and swivel 3 would not be necessary.

Further in the alternative, it should be noted that swivel 3 could be placed on the other side of gear box 2, i.e., with gear box 2 between swivel 3 and reamer 8, so long as communication of the clean fluid is maintained to reamer 8 via gear box 2. Further in the alternative, a mud motor may be provided which is powered by the pressurized clean drilling fluid pumped into hole cleaner 20. Such a mud motor could drive pump 14 via gear box 2, in lieu of pump 14 being driven by rotation of drill pipe 9.

Referring again to FIG. 3, the operation of hole cleaner 20 according to the preferred embodiment will now be described. Clean drilling fluid is pumped from the surface into inlet pipe 12, and to the front of reamer 8 via inlet line 13, swivel 3, and through the interior of housing 5 to exit at reamer 8. Drill pipe 9 is rotated, and preferably also pulled, from the surface at entry opening O, so that: reamer 8 cuts the earth in advance of hole cleaner 20. The cuttings generated by the action of reamer 8 on the earth pass through intake grill 7, and are agitated within hole cleaner 20 by paddle 6, which is powered by the rotation of drill pipe 9. These cuttings, entrained in the lubricating and drilling fluid from reamer 8, then pass through intake pipes 10 to positive displacement pump 14, which is powered by the rotation of drill pipe 9 transmitted via drive shaft 5, coupler 1, gear box 2, and coupler 21. Positive displacement pump 14 pumps out the fluid with entrained cuttings to the surface, at exit location E, via discharge pipe 11. As a result, the cuttings generated by the reaming operation are discharged from the reaming location, reducing the likelihood of packing or other buildup, which in turn reduces the undesired effects of sticking of the reamer and trailing pipe, and reduces wear on the bit surfaces of reamer 8.

It should be noted that it is especially beneficial to have the discharge pipe 11 inside of the inlet pipe 12, since the solid material will be more likely to create blockages than will the clean fluid. In the event of a blockage in discharge pipe 11, another pipe such as a smaller drill pipe can be run from the surface into discharge pipe 11 to cut through or otherwise remove the blockage. Such removal of blockages from packed cuttings and other solid material is easier within a pipe than in an annulus, as would be the case if the clean fluid were pumped in through pipe 11 and the entrained cuttings back through the annulus between pipes 11 and 12.

Figure 7:
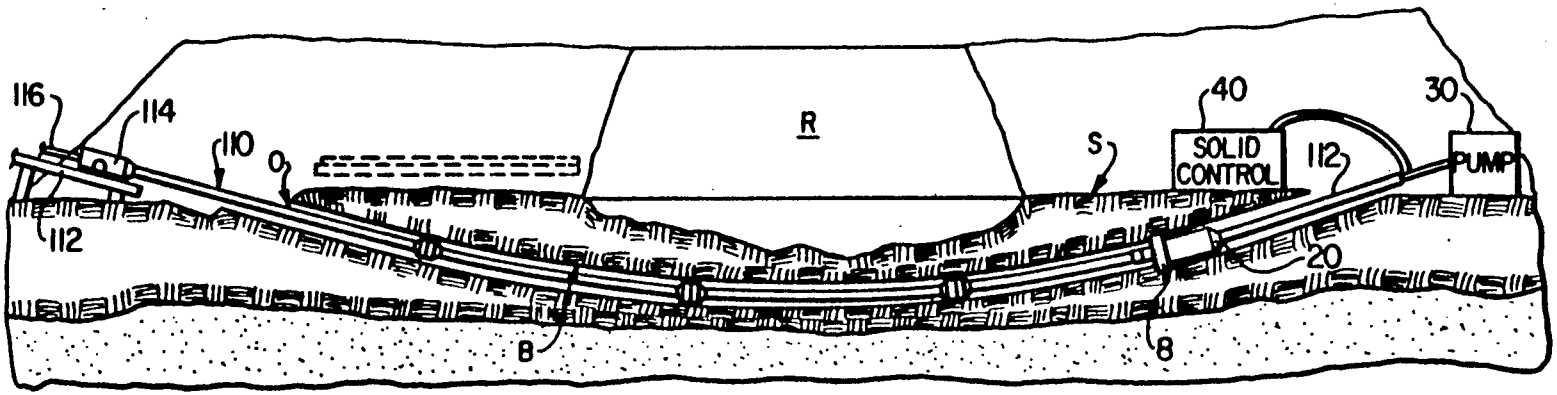
FIG. 7 is a schematic cross-sectional diagram illustrating the use of the embodiment of FIG. 3 in an initial reaming operation.

Referring to FIG. 7, a schematic illustration of a pre-reaming operation according to this embodiment of the invention will be described. Hole cleaner 20 is shown as being pulled into borehole B by motor 114 and carriage 116 at entry O at surface S, in the manner described hereinabove. Trailing hole cleaner 20 is inlet pipe 12, disposed within which is discharge pipe 11 (not visible in the view of FIG. 7). Pump 30 is in fluid communication with the annulus between inlet pipe 12 and discharge pipe 11, and is a conventional pump for pumping drilling or lubrication fluid or mud into hole cleaner 20 via this annulus, as described hereinabove. Solid control apparatus 40 is in communication with discharge pipe 11, and receives the fluid with entrained cuttings from hole cleaner 20 via discharge pipe 11 in the manner described above, for storage, recycling or other processing of the fluid and cuttings in the conventional manner.

It is contemplated that pumping of the fluid or mud may not be necessary, as the depth of hole cleaner 20 below the surface may be sufficient that the hydrostatic pressure is sufficient to maintain sufficient flow of the fluid into hole cleaner 20, with positive displacement pump 14 operable to pump the fluid and entrained cuttings out discharge pipe 11 at the surface. However, the best results of the reaming operation would be expected with the use of pump 30.

In the event that a pump 30 is used, it is preferred that a balance in the amount of fluid pumped into hole cleaner 20 be maintained, relative to the amount of fluid and cuttings withdrawn from discharge pipe 11. As noted hereinabove, an overpressurized situation at reamer 8 is not desired, due to the sticking and wear factors discussed hereinabove. In addition, a vacuum is undesired as well, as the formation surrounding borehole B and expanded borehole D could collapse in such a case. The pressure balance can be maintained by monitoring the volume of fluid pumped into inlet pipe 12, and monitoring such other known factors as the RPM of positive displacement pump 14 and the rate at which reamer 8 and hole cleaner 20 are moving along path B. In addition, a pressure gauge (not shown) may be included within hole cleaner 20, in communication with the surface, so that pump 30 can be controlled according to a direct measurement of the pressure at reamer 8, with overpressure and vacuum prevented by proper control of the operation of pump 30. It is preferable that such a pressure gauge be disposed in hole cleaner 20 near reamer 8, to ensure that pressure buildup is monitored at the location at which overpressure or underpressure is most likely to occur. The above-cited U.S. Pat. Nos. 4,176,985, 4,221,503 and 4,121,673, incorporated herein by this reference, describe control of the entry and withdrawal of drilling fluid and mud and the benefits of such control, in the contex of forward thrust installation of production casing.

It should be noted that, in the operation illustrated in FIG. 7, pump 30 and solid control system 40 are both disposed at the exit opening E, with only the motor 114 and carriage 116 located at the entry opening 0. It has been found that it is more convenient to pump in the clean fluid from the same side at which the fluid with entrained cuttings is discharged, so that cleaning and re-use of the fluid can be performed without requiring transportation of fluid from one end of the path to the other and back again. It should be noted that conventional reamers, as described above relative to FIG. 1, receive their lubricating mud or fluid from the same side as the driving motor, such as motor 114. However, this embodiment of the invention includes the removal of the fluid with its entrained cuttings from the trailing end of the reamer 8 and hole cleaner 20; accordingly, the conventional direction of fluid from entry opening O would be inconvenient, as re-use of the fluid would require its transport across river R. Therefore, according to the preferred embodiment of the invention, both pump 30 and solid control system 40 are located at the exit location E, with only the drive mechanism of motor 114 and carriage 116, or such other equivalent mechanism for pulling and rotating drill string 10, at the entry location O.

Figure 1:
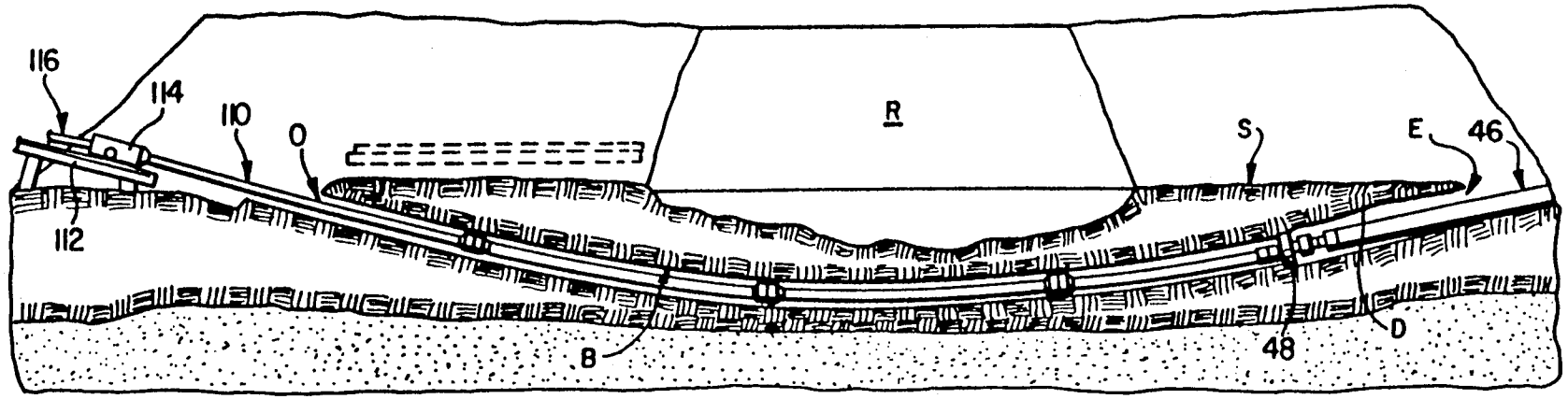
FIGS. 1 and 2 are cross-sectional drawings showing an apparatus for reaming and installing a conduit according to the prior art.

As noted above, the operation of FIG. 7 is an initial reaming, or pre-reaming, operation, after which the installation of production conduit 46 can be performed. It is contemplated that hole cleaner 20 and its method of removing cuttings can be used in an operation where the production casing, such as conduit 46 of FIGS. 1 and 2, is attached to hole cleaner 20; it is preferred, in such a case, either that the conduit itself be used as inlet pipe 12, with discharge pipe 11 disposed therewithin, or that both inlet pipe 12 and discharge pipe 11 are disposed within the production conduit.

It should further be noted that the operation described above using hole cleaner 20 may alternatively be formed after one or more conventional reaming operations have been performed, and in which the cuttings from such reaming are left behind. Multiple stages of reaming may be preferred, depending upon the formations, in order to progressively ream the borehole from the size of the pilot borehole to a sufficiently large diameter as to accept the production conduit. Hole cleaner 20, including reamer 8 at its leading end, could then be pulled through the path previously reamed to clean out the cuttings; the production conduit 46 could either be installed in yet another separate step following the cleaning operation by hole cleaner 20, or it could be installed during this cleaning operation. It should be noted that while the benefits of the invention relating to the reduction of sticking would be achieved by such a separate cleaning operation using hole cleaner 20 according to this invention, the best results, especially considering the benefits of reducing wear on the reamer as described above, would be achieved by using hole cleaner 20 in the initial reaming operation.

Further in the alternative, the fluid and cuttings can be discharged at the location toward which the hole cleaner 20 and reamer 48 are being pulled, which in this example is entry location O. In such an alternative arrangement, a discharge pipe such as discharge pipe 11 is preferably disposed within drill string 9, in a similar manner and for similar reasons as discharge pipe 11 is disposed within intake pipe 12 of FIG. 3. Pump 14 would of course have its outlet disposed forwardly, toward reamer 8, in such an arrangement.

While the invention has been described herein relative to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

I claim:

1. An apparatus for removing cuttings from a borehole, comprising:

a coupler for receiving a powering pipe at a first end of the apparatus;

an intake line disposed near said first end of the apparatus;

a reamer disposed at said first end ahead of said intake line, said reamer rotatable by rotation of said powering pipe;

a pump having an input connected to said intake line and having an output; and a discharge pipe connected to the output of said pump, and extending from a second end of the apparatus.

2. The apparatus of claim 1, further comprising:

a housing, within which said pump and intake line are disposed.

3. The apparatus of claim 1, further comprising:

a reamer disposed at said first end, and ahead of said intake line, said reamer rotatable by rotation of said powering pipe; and an inlet pipe, disposed at said second end, for receiving lubricating fluid, said inlet pipe in fluid communication with said reamer.

4. An apparatus for removing cuttings from a borehole, comprising:

a coupler for receiving a powering pipe at a first end of the apparatus;

an intake line disposed near said first end of the apparatus;

a pump having an input connected to said intake line and having an output, said pump powered by rotation of said powering pipe;

a discharge pipe connected to the output of said pump, and extending from a second end of the apparatus;

a reamer disposed at said first end ahead of said intake line, said reamer rotatable by rotation of said powering pipe; and a paddle disposed between said reamer and said intake line, said paddle rotatable by rotation of said powering pipe.

5. A method of cleaning an underground path between a first and a second surface location, comprising:

pulling a hole cleaner along said path from said first location, said hole cleaner being attached to a drill pipe in said path and having a pump disposed therewithin having an intake in said path and a discharge;

rotating said drill pipe during said pulling step, wherein said pump pumps fluid and cuttings from its intake to its discharge responsive to said rotating; and pumping lubricating fluid from said second location through an inlet pipe to said reamer;

wherein said pump pumps fluid and cuttings to said discharge through a discharge pipe disposed within said inlet pipe.

6. An apparatus for removing cuttings from a borehole, comprising:

a coupler for receiving a powering pipe at a first end of the apparatus;

an intake line disposed near said first end of the apparatus;

a pump having an input connected to said intake line and having an output, said pump powered by rotation of said powering pipe;

a reamer disposed at said first end, and ahead of said intake line, said reamer rotatable by rotation of said powering pipe;

an inlet pipe, disposed at said second end, for receiving lubricating fluid, said inlet pipe in fluid communication with said reamer; and a discharge pipe connected to the output of said pump, and extending from a second end of the apparatus, and disposed within said inlet pipe, so that the lubricating fluid received by said inlet pipe travels between the interior of said inlet pipe and the exterior of said discharge pipe.

7. The apparatus of claim 6, further comprising:

a gear box, connected between said powering pipe and said pump, for communicating rotation of said powering pipe to said pump.

8. An apparatus for removing cuttings from a borehole, comprising:

a coupler for receiving a powering pipe at a first end of the apparatus;

an intake line disposed near said first end of the apparatus;

a pump having an input connected to said intake line and having an output, said pump powered by rotation of said powering pipe;

a discharge pipe connected to the output of said pump, and extending from a second end of the apparatus; and a gear box, connected between said powering pipe and said pump, for communicating rotation of said powering pipe to said pump.

9. The apparatus of claim 8, further comprising:

an inlet pipe, disposed at said second end, for receiving lubricating fluid;

an inlet line having a first end in fluid communication with said inlet pipe; and a swivel disposed between said gear box and said powering pipe, said swivel having a side entry receiving a second end of said inlet line, so that lubricating fluid received by said inlet pipe is communicated to said reamer through said swivel.

10. A method of enlarging a path between first and second surface locations, comprising:

rotating and advancing a drill pipe from said first surface location, said drill pipe having attached thereto a reamer so that said rotating and advancing enlarge said path; and pumping fluid and cuttings from behind said reamer to said second surface location.

11. The method of claim 10, further comprising:

introducing fluid to said reamer from said second surface location.

12. The method of claim 11, wherein said introducing step comprises:

pumping said fluid through an inlet pipe to said reamer.

13. The method of claim 10, wherein a conduit is coupled to said reamer, so that the pulling of said drill pipe pulls said conduit into the enlarged path.

14. A method of enlarging a path between first and second surface locations, comprising:

rotating and advancing a drill pipe from said first surface location, said drill pipe having attached thereto a reamer so that said rotating and advancing enlarge said path;

pumping fluid and cuttings from behind said reamer to said second surface location;

rotating said drill pipe without pulling said drill pipe; and during said rotating without pulling step, agitating fluid and entrained cuttings from behind said reamer.

15. The method of claim 14, wherein said pumping pumps the fluid and cuttings from the location of said agitating.

16. A method of enlarging a path between first and second surface locations, comprising:

rotating and advancing a drill pipe from said first surface location, said drill pipe having attached thereto a reamer so that said rotating and advancing enlarge said path;

pumping said fluid through an inlet pipe to said reamer;

pumping fluid and cuttings from behind said reamer to said second surface location, in a manner powered by the rotating of the drill pipe;

monitoring the pressure near said reamer; and controlling the pumping of said fluid responsive to the monitored pressure near said reamer.

17. A method of cleaning an underground path between a first and a second surface location, comprising:

pulling a hole cleaner along said path from said first location, said hole cleaner being attached to a drill pipe in said path and having a pump disposed therewithin having an intake in said path and a discharge for pumping fluid and cuttings from its intake to its discharge during said pulling step, so that the pumped fluid and cuttings exit said path at said second surface location.

18. The method of claim 17, wherein said drill pipe is coupled to a product conduit disposed behind said hole cleaner, so that said pulling step pulls said product conduit into the path cleaned by said hole cleaner.

19. The method of claim 17, further comprising:

enlarging said path with a reamer which rotates responsive to said rotating step.

20. The method of claim 19, further comprising:

enlarging the entire length of said path, prior to said pulling step, with a reamer having a size larger than said hole cleaner.

21. The method of claim 19, wherein said reamer is connected to said drill pipe in advance of said hole cleaner;

and further comprising:

introducing fluid from said second location to said reamer.

22. The method of claim 21, wherein said introducing step comprises:

pumping said fluid from said second location through an inlet pipe to said reamer.

23. A hole cleaning apparatus comprising:

a housing having a first end for coupling to a drill pipe;

a reamer located at said first end of said housing, said reamer coupling to said drill pipe when coupled into said housing;

a pump disposed within said housing, having an intake disposed near said reamer, and a discharge at a second end of said housing;

a shaft for powering said pump, said shaft coupled to said drill pipe by said coupling, so that rotation of said drill pipe powers said pump; and gears, for coupling said drill pipe to said shaft in such a manner that said shaft rotates at a different rate than said drill pipe.

24. A method of cleaning an underground path between a first and a second surface location, comprising:

pulling a hole cleaner along said path from said first location, said hole cleaner being attached to a drill pipe in said path and having a pump disposed therewithin having an intake in said path and a discharge, said discharge of said pump discharging the fluid and cuttings at said second surface location;

rotating said drill pipe during said pulling step, wherein said pump pumps fluid and cuttings from its intake to its discharge responsive to said rotating;

enlarging said path with a reamer which rotates responsive to said rotating step, said reamer connected to said drill pipe in advance of said hole cleaner;

pumping said fluid from said second location through an inlet pipe to said reamer;

monitoring pressure near said reamer; and controlling said pumping step responsive to the monitored pressure near said reamer.

25. A method of cleaning an underground path between a first and a second surface location, comprising:

pulling a hole cleaner along said path from said first location, said hole cleaner being attached to a drill pipe in said path and having a pump disposed therewithin having an intake in said path and a discharge;

rotating said drill pipe during said pulling step, wherein said pump pumps fluid and cuttings from its intake to its discharge responsive to said rotating;

enlarging said path with a reamer which rotates responsive to said rotating step; and agitating fluid and cuttings at a location behind said reamer, responsive to said rotating step.

26. The method of claim 25, further comprising:

stopping said pulling of said drill pipe, while rotating said drill pipe;

wherein said agitating step continues during said stopping step.

27. A hole cleaning apparatus, comprising:

a housing having a first end for coupling to a drill pipe;

a reamer located at said first end of said housing, said reamer coupling to said drill pipe when coupled into said housing;

a pump disposed within said housing, having an intake disposed near said reamer, and a discharge at a second end of said housing; and an intake grill having holes therethrough, said intake grill disposed between said reamer and the intake of said pump near said first end of said housing.

28. The hole cleaning apparatus of claim 27, further comprising a rod disposed in contact with said intake grill, said rod having protrusions thereon which cooperate with said holes in said intake grill;

and wherein said coupling also couples said drill pipe to said rod so that rotation of said drill pipe rotates said rod radially about the axis of said hole cleaning apparatus in such a manner that the protrusions thereon clean the holes in said intake grill.

29. A hole cleaning apparatus, comprising:

a housing having a first end for coupling to a drill pipe;

a reamer located at said first end of said housing, said reamer coupling to said drill pipe when coupled into said housing;

a pump disposed within said housing, having an intake disposed near said reamer, and a discharge at a second end of said housing; and a paddle disposed between said reamer and the intake of said pump near said first end of said housing, said paddle coupling to said drill pipe when coupled to said housing so that rotation of said drill pipe rotates said paddle.

30. The hole cleaning apparatus of claim 29, further comprising:

a shaft for powering said pump;

and wherein said coupling also couples said drill pipe to said shaft, so that rotation of said drill pipe powers said pump.

* * * * *